US007958828B1

(12) United States Patent
Kapeles et al.

(10) Patent No.: US 7,958,828 B1
(45) Date of Patent: Jun. 14, 2011

(54) DRAG STABILIZED LOW LETHALITY IMPACT MUNITIONS AND METHODS

(75) Inventors: John A. Kapeles, Casper, WY (US); John A. Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 218 days.

(21) Appl. No.: 12/181,699

(22) Filed: Jul. 29, 2008

Related U.S. Application Data

(60) Provisional application No. 60/953,810, filed on Aug. 3, 2007.

(51) Int. Cl.
*F42B 12/02* (2006.01)
*F42B 12/34* (2006.01)

(52) U.S. Cl. ..... 102/502

(58) Field of Classification Search ..... 102/502, 102/504, 436, 439, 449, 457, 529; 473/575
See application file for complete search history.

(56) References Cited

U.S. PATENT DOCUMENTS 1,309,530 A * 7/1919 Lamberson ..... 102/504
3,780,662 A * 12/1973 Sorenson ..... 102/504
3,952,662 A 4/1976 Greenlees
4,327,644 A * 5/1982 Stancil ..... 102/504
4,418,624 A * 12/1983 Willi et al. ..... 102/473
4,664,034 A * 5/1987 Christian ..... 102/457
5,361,700 A * 11/1994 Carbone ..... 102/439
5,450,795 A 9/1995 Adelman
6,752,086 B2 6/2004 Kravel et al.
6,862,995 B2 3/2005 Kerr
6,997,110 B2 * 2/2006 Rastegar ..... 102/502
7,131,381 B1 * 11/2006 Nafziger ..... 102/444
7,278,357 B2 10/2007 Keith et al.
2004/0255813 A1 * 12/2004 Kerr ..... 102/502

OTHER PUBLICATIONS

Defense Technology Corporation of America 2001 Specification Manual on Drag Stabilized 12-Gauge Bean Bag (3 pages) (enclosed).

* cited by examiner

*Primary Examiner* — Bret Hayes
(74) *Attorney, Agent, or Firm* — Renner, Otto, Boisselle & Sklar, LLP

(57) ABSTRACT

A drag stabilized low lethality impact munition includes a sub-munition packaged in shell case. The sub-munition includes a main body having a trailing feature that is folded to extend at least partway around at least one of the sides of the main body toward the top of the main body. After folding, the sub-munition is inserted into the shell case, bottom first, while maintaining at least a portion of the trailing feature along at least one of the sides of the main body.

20 Claims, 3 Drawing Sheets

DRAG STABILIZED LOW LETHALITY IMPACT MUNITIONS AND METHODS

CROSS-REFERENCE TO RELATED APPLICATIONS

This application claims the benefit of U.S. Provisional Application No. 60/953,810, filed Aug. 3, 2007.

FIELD OF THE INVENTION

This invention relates generally to the field of drag stabilized low lethality impact munitions which impart blunt energy to redirect, control and/or incapacitate aggressive human targets, and specifically to such munitions that include sub-munitions with trailing features and assembly methods designed to cause optimal deployment of the trailing features during flight to improve and expand operational limits.

BACKGROUND OF THE INVENTION

Low lethality impact munitions are available in a number of configurations and calibers. These munitions may be designed for use against multiple subjects (area effect), or a single subject (point control). Area effect munitions are comprised of loaded munition platforms which contain multiple sub-munitions that may be discharged into a group of two or more subjects (i.e., human targets). Point control munitions are normally loaded with a single sub-munition. These latter munitions are typically designed to be more accurate and allow for more precise single target acquisition and deployment.

The design of low lethality impact sub-munitions ranges from basic wooden batons and rubber balls to advanced drag and spin stabilized designs. Accuracy of the sub-munitions is dependent on the munitions' caliber and intended use. Advanced large caliber point control type munitions rely on spin stabilization for increased accuracy. These munitions are designed to interface with internal rifling features in the large caliber launcher barrels which cause the sub-munitions to spin up when discharged. While this type of stabilization yields a round with exceptional accuracy and broader range performance, these large caliber launchers are not as common as smooth bore launchers which do not have features to induce spinning of the sub-munitions.

Smooth bore low lethality impact munitions can be broken into two different types, stabilized and non-stabilized. Non-stabilized munitions do not utilize any design features to aid in their accuracy or performance, and are mainly used in area effect deployments. Stabilized smooth bore munitions typically are designed to include either fin or drag stabilization. Fin stabilized sub-munitions are designed with fin features that induce a spin and/or are intended to stabilize their flight path. Drag stabilized munitions are designed with features that will trail behind the sub-munition main body during flight to produce a drag effect which in turn stabilizes the sub-munitions.

A problem with current drag stabilized munitions is that the feature(s) that are intended to trail the sub-munition main body during flight do not consistently deploy and trail as intended. The trailing feature often remains bunched up at the sub-munition main body resulting in non-uniform deployment of the trailing feature or no deployment at all. This bunching/non-deployment problem is present to varying degrees in virtually all drag stabilized sub-munitions regardless of construction or trailing feature configuration, and can lead to greater observed variability and performance of the sub-munitions.

SUMMARY OF THE INVENTION

The present invention relates to various drag stabilized munitions and assembly methods which insure the deployment of the sub-munition trailing feature during flight. One such assembly method involves the folding or placement of the trailing feature evenly over the sides of the sub-munition main body and packaging the majority of the length of the trailing feature over the top of the sub-munition main body in the shell case. Another assembly method involves partially folding the trailing feature up the sides of the sub-munition main body so a substantial portion of the length of the trailing feature is packaged below the sub-munition main body when loaded into the shell case.

Still another assembly method involves the grouping of the trailing feature together and folding or placing the grouped trailing feature along one side and on top of the sub-munition main body when loaded into the shell case. Still another assembly method involves folding or placing the grouped trailing feature partially up one side of the main body so a substantial portion of the length of the grouped trailing feature is packaged below the sub-munition main body when loaded into the shell case.

These and other advantages, features and aspects of the present invention will become apparent as the following description proceeds.

DETAILED DESCRIPTION OF THE INVENTION

Figure 1:
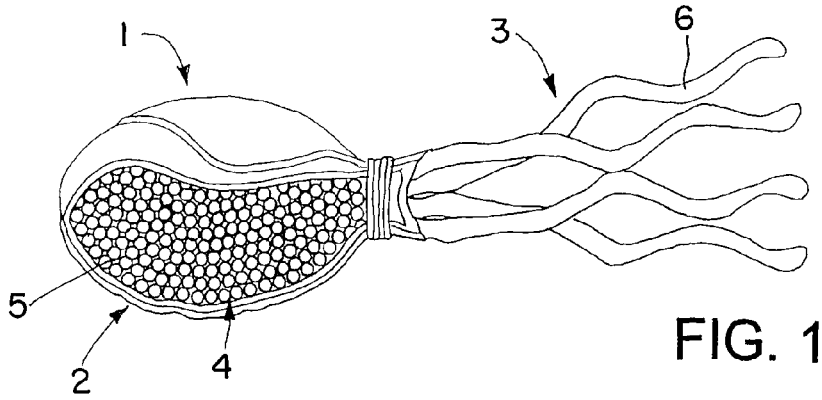
FIG. 1 is a fragmentary side elevation view, partly in section, of an exemplary drag stabilized sub-munition of the present invention showing the trailing feature of the sub-munition deployed behind the sub-munition main body.

Referring now in detail to the drawings, wherein like reference numerals are used to indicate like parts, and initially to FIG. 1, there is shown one form of drag stabilized sub-munition 1 of the present invention which can be divided into two main sections, a main body 2 and a trailing feature 3. The main body 2 may be comprised for example of a rigid solid part or a conforming closed vessel or compartment 4 filled with a suitable ballast material 5 to impact low lethality blunt energy to the target on impact. Typically the ballast material is shot or pellets, but other ballast materials may be used as well including for example relatively heavy powders or gels or encapsulated liquids or a single piece of ballast material such as a densified rubber that impart the required blunt energy to the target on impact.

The materials used to construct the trailing feature 3 may but need not be of the same type used in the main body section. For example, the trailing feature 3 may be a single or multiple foldable pliable appendages or strands 6 or foldable pliable tubular webbing, and may be secured to the main body as by sewing, stapling, gluing or similar means or may be tied off as a foldable pliable extension of the main body material as shown in FIG. 1.

The sub-munition 1 is loaded into a munition or shell case as described hereafter, and may be held in the shell case by various closure methods including, for example, crimping, rolling and interference locking. From the time the sub-munition 1 is loaded into the shell case, it begins to retain its loaded shape, which is dependent on numerous factors including the materials used to make the sub-munition, the extent to which the sub-munition is compressed into the shell case, and the method by which the sub-munition is placed into the shell case.

Figure 2:
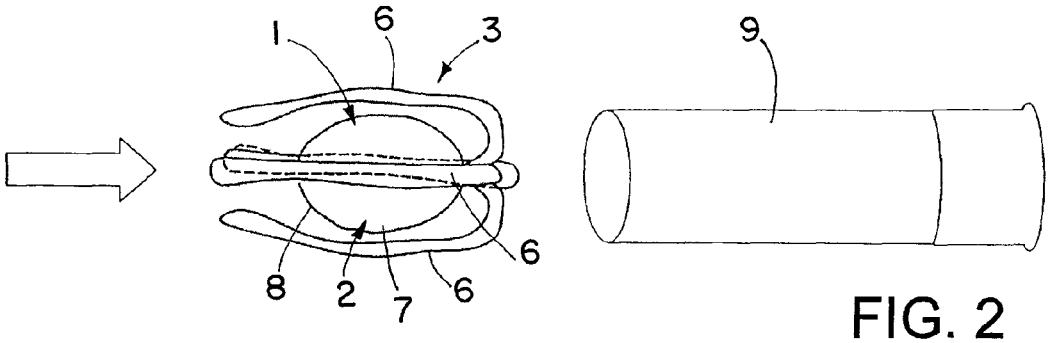
FIG. 2 is a schematic side elevation view of the sub-munition of FIG. 1 showing the trailing feature evenly folded around the sides of the sub-munition main body preparatory to inserting the sub-munition into a shell case.
Figure 3:
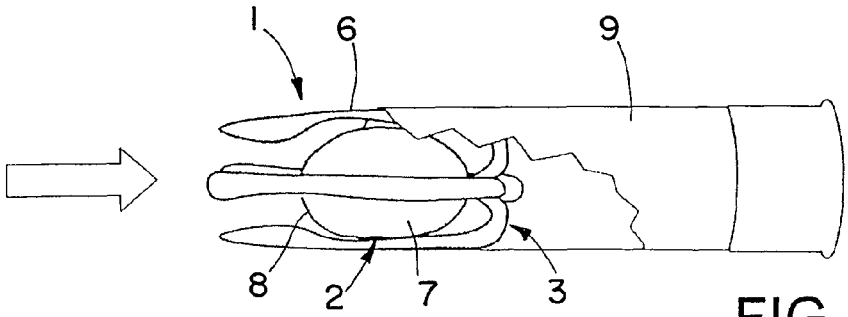
FIG. 3 is a schematic side elevation view, partly in section, showing the sub-munition of FIG. 2 being inserted into the shell case.
Figure 4:
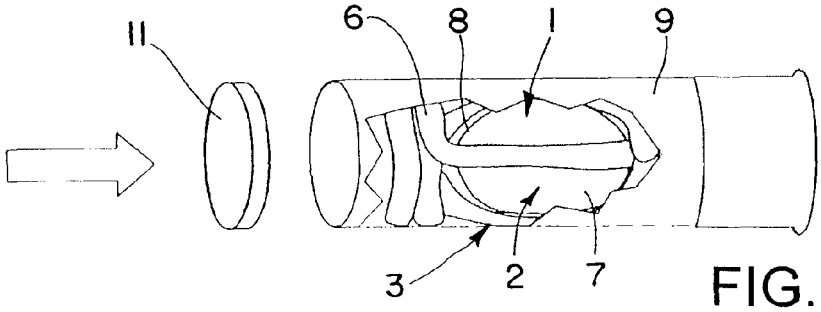
FIG. 4 is a schematic side elevation view, partly in section, showing the sub-munition of FIG. 3 fully inserted into the shell case with a substantial portion of the length of the trailing feature packaged over the top of the sub-munition main body in the shell case before locking the sub-munition in the shell case.

The present invention relates to various assembly methods for assembling the sub-munitions into the shell case and to the resulting munitions which ensure deployment of the trailing feature of the sub-munitions during flight after discharge from the shell case. Where the sub-munition trailing feature 3 includes multiple strands 6 as shown in FIG. 1, one such method involves folding or placing the multiple strands relatively evenly over the sides 7 and top 8 of the sub-munition main body 2 as shown in FIG. 2 prior to inserting the sub-munition into a shell case 9. Then the sub-munition 1 is inserted into the shell case 9 while maintaining the strands 6 along the sides of the sub-munition main body as shown in FIG. 3 so that a substantial portion of the length of the strands 4 is packaged over the top 8 of the sub-munition main body 2 when the sub-munition 1 is fully inserted into the shell case 9 as shown in FIG. 4.

Figure 5:
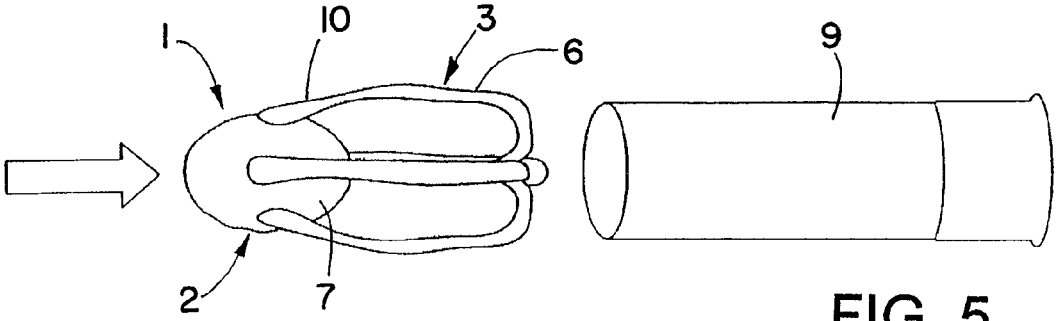
FIG. 5 is a schematic side elevation view of the sub-munition of FIG. 1 showing the trailing feature partially folded evenly over the sides of the sub-munition main body preparatory to inserting the sub-munition into a shell case.
Figure 6:
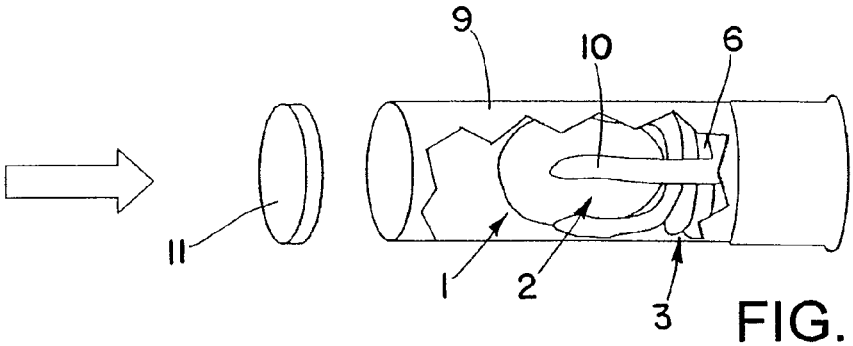
FIG. 6 is a side elevation view, partly in section, showing the sub-munition of FIG. 5 fully inserted into the shell case with a substantial portion of the length of the trailing feature packaged beneath the sub-munition main body in the shell case prior to locking the sub-munition in the shell case.

Alternatively, only the outer end portions 10 of the trailing feature strands 6 may be folded partially over the sides 7 of the sub-munition main body 2 prior to insertion into the shell case 9 as shown in FIG. 5 so that a substantial portion of the length of the strands 6 is packaged below the sub-munition main body 2 when fully inserted into the shell case as shown in FIG. 6.

Figure 7:
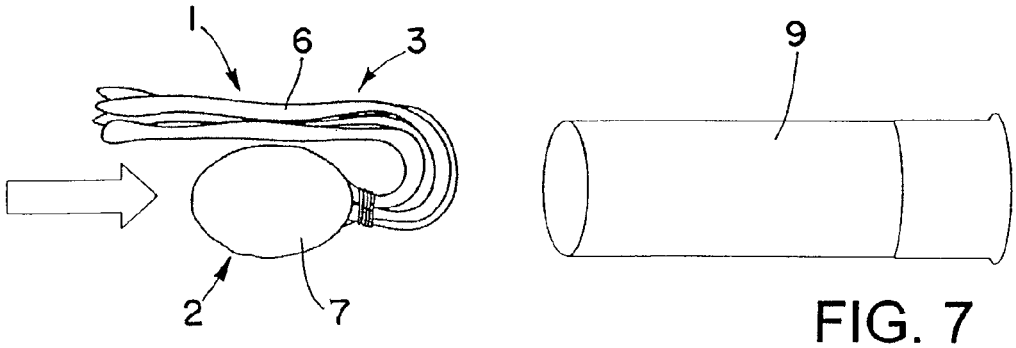
FIG. 7 is a schematic side elevation view of the sub-munition of FIG. 1 showing the trailing feature grouped together and folded and placed along one side of the sub-munition main body preparatory to inserting the sub-munition into a shell case.
Figure 8:
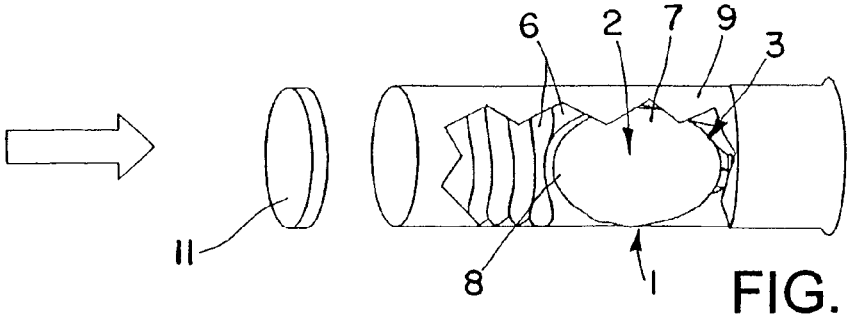
FIG. 8 is a schematic side elevation view, partly in section, showing the sub-munition of FIG. 7 fully inserted into the shell case with a substantial portion of the length of the trailing feature packaged over the top of the sub-munition main body prior to locking the sub-munition in the shell case.

In another embodiment of the assembly method shown in FIGS. 7 and 8, the trailing feature appendages or strands 6 are grouped together and folded or placed along one side 7 and on top 8 of the sub-munition main body 2 prior to insertion of the sub-munition 1 into the shell case 9 as shown in FIG. 7 so that when the sub-munition is fully inserted into the shell case as shown in FIG. 8, a substantial portion of the length of the grouped trailing feature strands are packaged over the top of the sub-munition main body as shown in FIG. 8.

Figure 9:
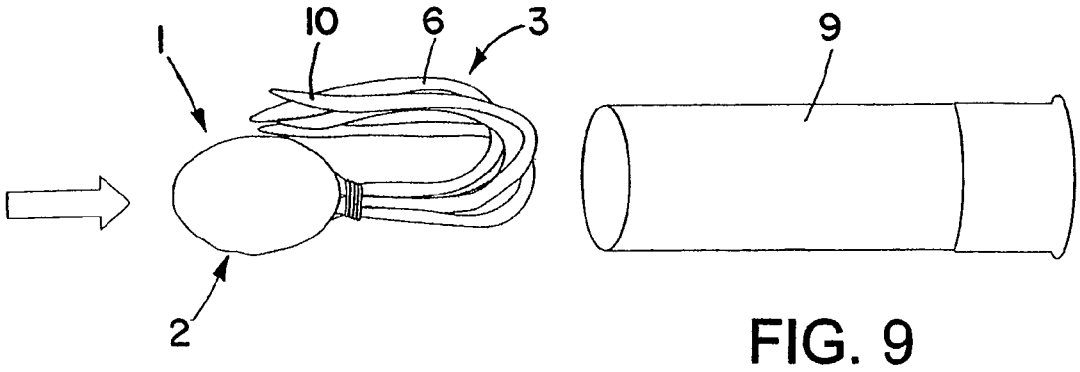
FIG. 9 is a schematic side elevation view of the sub-munition of FIG. 1 showing the trailing feature grouped together and folded and placed partially up one side of the sub-munition main body preparatory to loading the sub-munition into a shell case.
Figure 10:
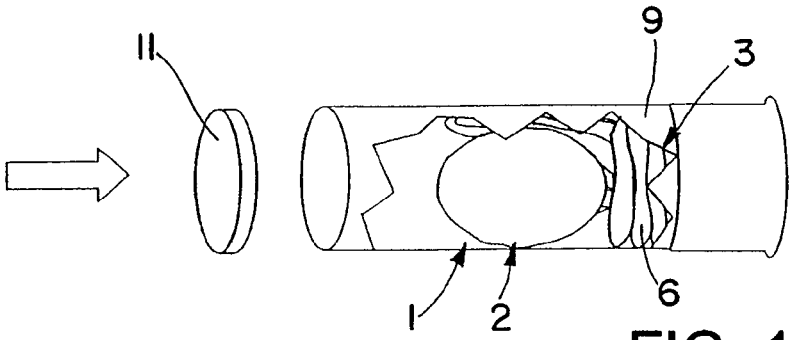
FIG. 10 is a side elevation view, partly in section, showing the sub-munition of FIG. 9 fully inserted into the shell case with a substantial portion of the length of the trailing feature packaged beneath the sub-munition main body in the shell case prior to locking the sub-munition in the shell case.

FIGS. 9 and 10 show still another sub-munition assembly method in which the trailing feature appendages or strands 6 are also grouped together prior to inserting the sub-munition 1 into the shell case 9. However, in this case instead of folding or placing the grouped trailing feature strands 6 along one side and on top of the sub-munition main body as shown in FIG. 7, only the outer ends 10 of the grouped trailing feature strands are placed partially up one side of the sub-munition main body as shown in FIG. 9 so that when the sub-munition is fully inserted into the shell case, a substantial portion of the length of the trailing feature strands is packaged beneath the main body 2 in the shell case as shown in FIG. 10.

Regardless of which of the above assembly methods is used to assemble the sub-munition into the shell case, the sub-munition may be held in place inside the shell case by means of any desired closure or sealing method including rolling or crimping closures such as top wads 11 on top of the sub-munition. Also the assembly method shown in FIGS. 9 and 10 is well suited for interference locking of the sub-munition in the shell case without the need for any rolling or crimping closures on top of the sub-munitions.

When any of these munitions made in accordance with the above described assembly methods are fired from a smooth bore launcher by igniting the munition propellant (not shown), the sub-munition 1 begins to leave the shell case 9 with at least a portion of the trailing feature 3 in a generally forward orientation. This subjects the trailing feature to any narrowing in the shell case or barrel, which assists in breaking any set or memory that the sub-munition trailing feature may have taken on inside the shell case. As the sub-munition reaches the end of the launcher barrel, the forward orientation of the trailing feature 3 is posed to catch any resultant air force it encounters. When the sub-munition exits the barrel, the force of the air flowing around and into the forwardly facing portion of the trailing feature causes the trailing feature to be forced backwards into the fully deployed drag stabilized position schematically shown in FIG. 1. Additionally, unlike sub-munitions loaded into shell cases with the entire length of the trailing feature packaged below the sub-munition main body in the shell case, any trailing shot wads (not shown) will not hinder proper deployment of the trailing feature of the sub-munition during flight.

Although the invention has been shown and described with respect to certain embodiments, it is obvious that equivalent alterations and modifications will occur to others skill in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A drag stabilized low lethality impact munition comprising a sub-munition packaged in a shell case, the sub-munition including a main body having sides and a forwardly facing top and rearwardly facing bottom, the main body being compressed within the shell case and including ballast means to impart low lethality blunt energy to a target upon impact when the sub-munition is fired from a smooth bore launcher, and a foldable drag stabilizing trailing feature extending from the bottom of the main body, the trailing feature having one or more free outer end portions extending at least partway around at least one of the sides toward the forwardly facing top of the main body within the shell case with at least a portion of the trailing feature facing in a generally forward direction.

2. The munition of claim 1 wherein a substantial portion of the length of the one or more free outer end portions of the trailing feature is packaged on top of the sub-munition main body within the shell case.

3. The munition of claim 1 wherein a substantial portion of the length of the one or more free outer end portions of the trailing feature is packaged underneath the bottom of the main body within the shell case.

4. The munition of claim 1 wherein the trailing feature includes multiple strands each having respective free outer end portions which are relatively evenly spaced around the sides of the sub-munition main body within the shell case.

5. The munition of claim 4 wherein a portion of the length of the free outer end portions of the strands is packaged on top of the main body within the shell case.

6. The munition of claim 5 wherein a substantial portion of the length of the free outer end portions of the strands is packaged on top of the main body within the shell case.

7. The munition of claim 1 wherein the trailing feature includes multiple strands each having respective free outer end portions which are grouped together and extend at least partway along one side of the sub-munition main body within the shell case.

8. The munition of claim 7 wherein a substantial portion of the length of the free outer end portions of the strands is packaged on top of the main body within the shell case.

9. The munition of claim 1 wherein the trailing feature is a single or multiple foldable pliable appendages, strands or webbing.

10. The munition of claim 9 wherein the trailing feature is a foldable pliable extension of the main body.

11. The munition of claim 9 wherein the trailing feature is secured to the main body.

12. A method of packaging a low lethality impact sub-munition in a shell case, wherein the sub-munition includes a main body having sides and a top and bottom, the main body including ballast means to impart low lethality blunt energy to a target when the sub-munition is fired from a smooth bore launcher, and a foldable drag stabilizing trailing feature extending from the bottom of the main body, the trailing feature having one or more free outer end portions, comprising the steps of folding the trailing feature so that the one or more free outer end portions of the trailing feature extend at least partway around at least one of the sides toward the top of the main body, and compressing the main body into the shell case, bottom first, while maintaining at least a portion of the one or more free outer end portions of the trailing feature along at least one of the sides of the main body.

13. The method of claim 12 wherein a portion of the length of the one or more free outer end portions of the trailing feature is packaged on top of the main body when the sub-munition is fully inserted into the shell case.

14. The method of claim 13 wherein a substantial portion of the length of the one or more free outer end portions of the trailing feature is packaged on top of the main body when the sub-munition is fully inserted into the shell case.

15. The method of claim 12 wherein a substantial portion of the length of the one or more free outer end portions of the trailing feature is packaged beneath the bottom of the main body when the sub-munition is fully inserted into the shell case.

16. The method of claim 12 wherein the trailing feature includes multiple strands each having respective free outer end portions which are folded over to extend at least partway around at least one of the sides toward the top of the main body during the folding step.

17. The method of claim 16 wherein portions of the free outer end portions of the respective strands are relatively evenly spaced around the sides of the main body and remaining portions of the free outer end portions are packaged on top of the main body when the sub-munition is fully inserted into the shell case.

18. The method of claim 16 wherein portions of the free outer end portions of the respective strands are relatively evenly spaced around the sides of the main body and remaining portions of the free outer end portions of the strands are packaged beneath the bottom of the main body when the sub-munition is fully inserted into the shell case.

19. The method of claim 16 wherein the free outer end portions of the respective strands are grouped together and portions of the grouped free outer end portions extend along one of the sides and on top of the main body when the sub-munition is fully inserted into the shell case.

20. The method of claim 16 wherein the free outer end portions of the strands are grouped together and portions of the grouped free outer end portions extend along one of the sides and beneath the bottom of the main body when the sub-munition is fully inserted into the shell case.

* * * * *